US005605240A

United States Patent [19]

Guglielmini

[11] Patent Number: 5,605,240

[45] Date of Patent: Feb. 25, 1997

[54] CAP FOR A CONTAINER HAVING A NECK HAVING A SINGLE ATTACHMENT FLANGE

[75] Inventor: Bernard Guglielmini, Crimolois, France

[73] Assignee: Rical S, A,, Longvic Cedex, France

[21] Appl. No.: 436,553

[22] Filed: May 8, 1995

[30] Foreign Application Priority Data

May 6, 1994 [FR] France ..... 94 05634

[51] Int. Cl.[6] ..... B65D 41/32

[52] U.S. Cl. ..... 215/256; 215/235

[58] Field of Search ..... 215/250, 253, 215/254, 320, 235, 256, 354; D9/435

[56] References Cited

U.S. PATENT DOCUMENTS

| | | | |
|---|---|---|---|
| 3,438,529 | 4/1969 | Löhrer . | |
| 3,441,161 | 4/1969 | Van Baarn | 215/320 X |
| 3,991,904 | 11/1976 | Davis et al. | 215/320 X |
| 4,129,226 | 12/1978 | Percival | 215/235 |
| 4,394,918 | 7/1983 | Grussen | 215/253 X |
| 4,860,907 | 8/1989 | Sondal | 215/235 X |
| 4,919,286 | 4/1990 | Agbay, Sr. | 215/254 X |
| 5,207,783 | 5/1993 | Burton | 215/256 |
| 5,464,112 | 11/1995 | Guillot | 215/254 |

FOREIGN PATENT DOCUMENTS

| | | | |
|---|---|---|---|
| 256652 | 9/1967 | Austria | 215/254 |
| 758873 | 5/1967 | Canada | 215/253 |
| 1319395 | 12/1963 | France | 215/320 |
| 1128815 | 10/1968 | United Kingdom | 215/320 |

*Primary Examiner*—Allan N. Shoap
*Assistant Examiner*—Nathan Newhouse
*Attorney, Agent, or Firm*—Beveridge, DeGrandi, Weilacher & Young, LLP

[57] ABSTRACT

Cap moulded in one piece, comprising a ring (7) having on the inside a bead (10) for attaching it to the neck (1) of the container to be capped, a stopper (8) joined by a hinge (15) to said ring (7) and having a sealing skirt (13), and a tamperproof strip (9) joining the stopper (8) to the ring (7) until the first time the cap is opened. To cap a container having a neck (1) with a single attachment flange (3), the stopper (8) includes an annular bearing surface (12) bearing on the upper edge (5) of the neck and surrounding said skirt (13), said skirt (13) projecting from said bearing surface (12) over a length (1) at least equal to the distance $h_1$ between the lower side (4) of the flange (3) and the upper edge (5) of the neck, and the hinge is offset relative to said annular bearing surface (12) towards the ring (7) by an amount ($h_2$) at least equal to said distance ($h_1$).

9 Claims, 4 Drawing Sheets

CAP FOR A CONTAINER HAVING A NECK HAVING A SINGLE ATTACHMENT FLANGE

The present invention concerns a tamperproof cap moulded in one piece for containers having a neck with a single external attachment flange at a small distance from the upper edge of the neck of the container.

Prior art tamperproof bottle caps moulded in one piece from plastics material include a ring having on the inside a bead for attachment to the neck of the bottle to be capped, a stopper joined by a hinge to said ring at one point on the perimeter of the cap and a tamperproof strip joining the stopper to the ring over the remainder of the perimeter of the cap until this strip is torn off when the bottle is opened for the first time. These prior art caps are designed to cap plastics material bottles having a neck which includes, in addition to a lower supporting flange required for the operation of fitting the cap, two superposed attachment flanges of which the lower attachment flange, located above the supporting flange, is used to attach the ring and the upper flange is used to attach the stopper which to this end also has a bead on the inside.

These prior art caps are totally satisfactory when used on the bottles for which they were designed.

However, the bottles in question have the drawback of requiring, for a given diameter of the neck opening, a relatively high neck because of the presence of the two superposed attachment flanges. Likewise, the caps fitted to the bottles have a corresponding height and also a relatively large diameter determined by the diameter of the lower attachment flange, which must be greater than the diameter of the upper attachment flange to enable the two-fold clipping of the cap to the neck (clipping of the ring over the lower flange and clipping of the stopper over the upper flange).

In the case of products consumed in very large quantities, such as food products, to reduce the weight and therefore the cost of the bottle and the cap fitted to it, it is beneficial for the bottle neck to have a single attachment flange, the neck then being both shorter and of smaller outside diameter than the neck with two attachment flanges. However, the prior art includes no caps of the type defined hereinabove for these short-necked bottles.

The present invention concerns a cap which, on a short container neck with a single attachment flange, fulfils not only the functions of the prior art caps (sealed closure, tamperproofing, captive stopper) but also holds the stopper in the open position, this cap being manufacturable at a competitive unit cost by virtue of its reduced weight and its simplicity of manufacture, among other things.

The cap of the invention, moulded in one piece, comprises a ring having on the inside a bead for attaching it by clipping behind an external flange of the neck of the container to be capped. The cap further comprises a stopper joined by a hinge to said ring and having a sealing skirt cooperating with the inside of the neck of the container. The cap further comprises a tamperproof strip joining the stopper to the ring until it is torn off the first time the cap is opened. To cap a container having a neck with a single attachment flange at a distance from the upper edge of the neck, the stopper includes an annular bearing surface bearing on the upper edge of the neck and surrounding said skirt, said skirt projecting from said bearing surface over a length at least equal to the distance between the lower side of the attachment flange and the upper edge of the neck of the container. The hinge joining the stopper to the ring is offset relative to said bearing surface towards the ring by an amount at least equal to said distance.

Thanks to these features the sealing skirt of the stopper, which remains attached to the ring when the tamperproof strip has been torn off, bears on the upper edge of the neck, when the stopper has been opened to an angle of 90° or more, so that the stopper is held in a stable open position for emptying out the contents of the container.

The length of the sealing skirt of the stopper is preferably greater than the distance between the lower side of the attachment flange of the neck and the upper edge of the neck.

In the case of containers in which this distance is very small, it is advantageous for the outside surface of the sealing skirt to be offset towards the hinge relative to the circular external perimeter of the stopper of the cap.

To achieve this offset it is possible for the inside surface of the skirt to be centred relative to the circular outside perimeter of the stopper of the cap and for the hinge side of the sealing skirt to be thicker in the radial direction than the opposite side.

One embodiment of a cap in accordance with the invention will now be described in more detail and by way of non-limiting illustrative example only with reference to the appended diagrammatic drawings. In the drawings.

Figure 1:
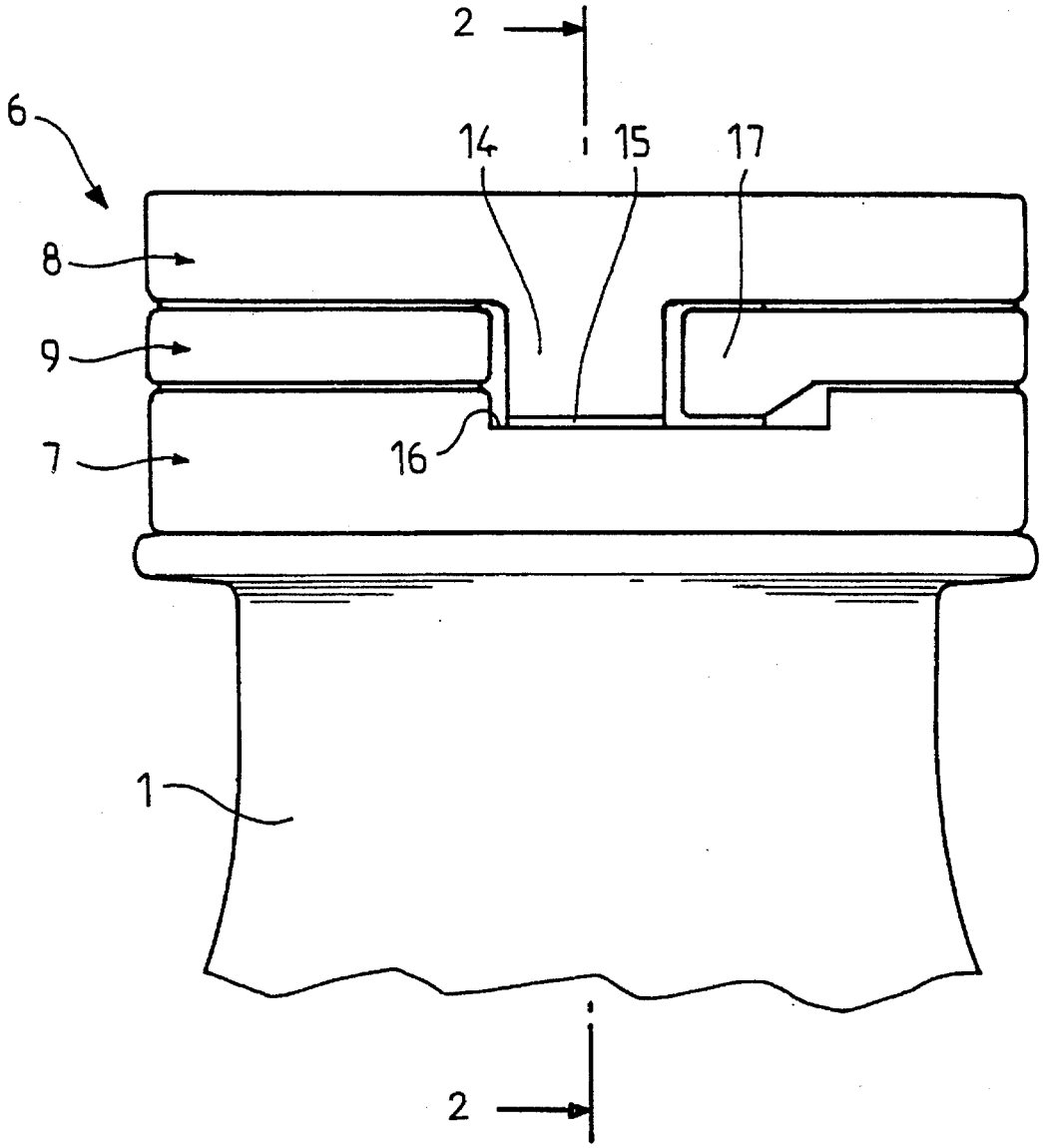
FIG. 1 is an exterior side view of the cap on a bottle neck.
Figure 2:
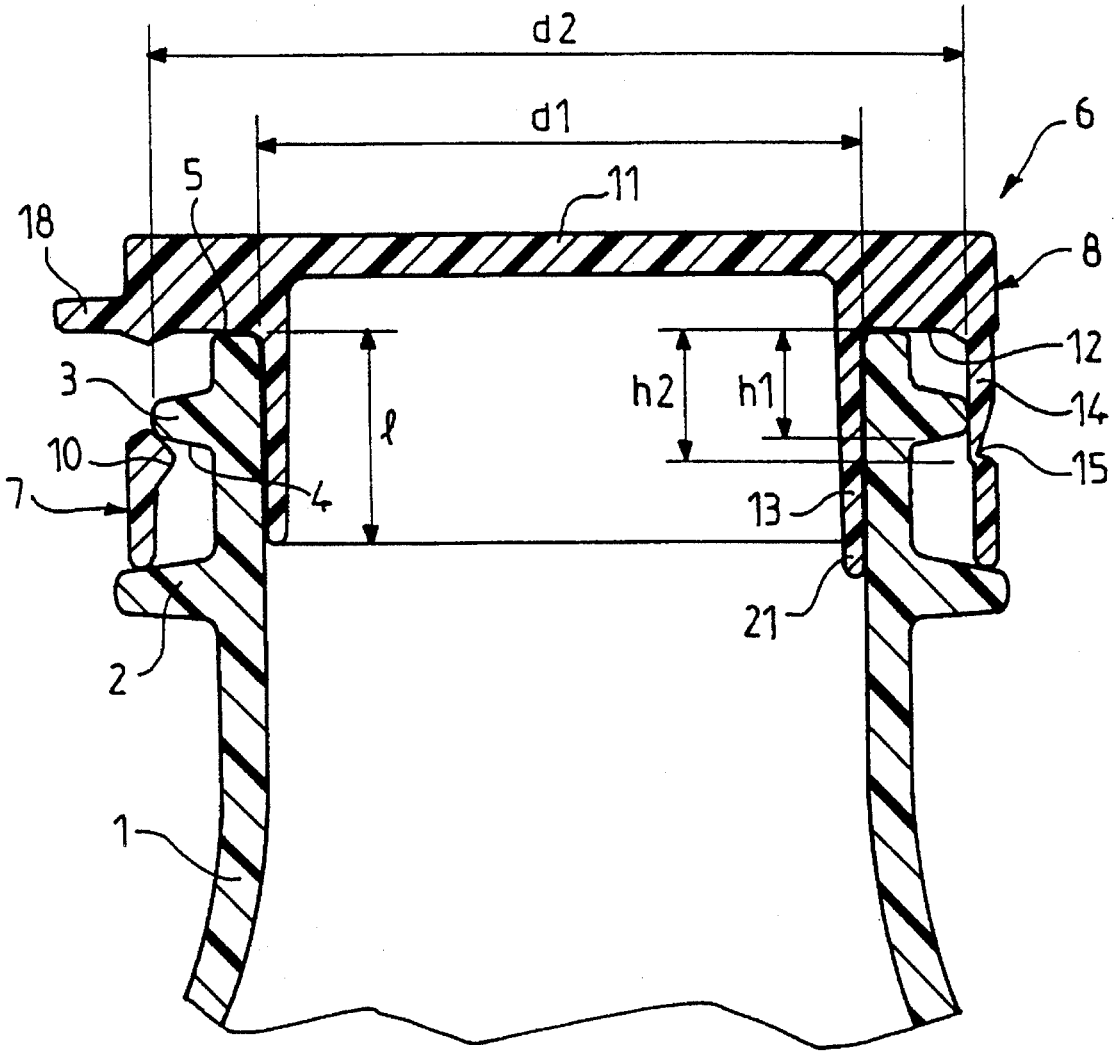
FIG. 2 is a section on II—II in FIG. 1.

Referring to FIGS. 1 and 2, the neck 1 of a container that is not shown in detail, for example a PET (polyethylene teraphthalate) bottle has on the outside a supporting flange 2 that is required for the operation of fitting the cap and a single attachment flange 3 above the supporting flange 2 and the lower side 4 of which is at a distance $h_1$ from the upper edge 5 of the neck 1. The neck 1 has an inside or opening diameter $d_1$ and the attachment flange 3 has an outside diameter $d_2$.

The neck 1 is stoppered by a cap 6 moulded in one piece from plastics material. The cap 6 comprises a ring 7, a stopper 8 and a tamperproof strip 9.

The ring 7 has a bead 10 on the inside to clip under the attachment flange 3 of the neck 1.

The stopper 8 includes a disk 11 defining an angular bearing surface 12 around a tubular sealing skirt 13 of length 1. The stopper 8 has at one point on its perimeter, and outside the annular bearing surface 12, a lug 14 projecting towards the ring 7 to which it is joined by a thin portion 15 forming a hinge. This hinge 15 is at a distance $h_2$ from the annular bearing surface 12.

There is a notch 16 in the top of the ring 7 at the location of the hinge 15 (see FIG. 1) and the bead 10 on the ring 7 is interrupted at the location of this notch.

The tamperproof strip 9 joins the stopper 8 to the ring 7 around all of the perimeter of the cap with the exception of the location of the lug 14, and therefore of the hinge 15, and is torn off when the cap is opened for the first time. To this end the ring 9 has a tear-off tab 17 at one end.

Opposite the lug 14, and therefore the hinge 15, the stopper 8 incorporates an extension 18 to facilitate grasping it for the purpose of opening it.

In FIG. 1 the tamperproof strip 9, which is joined to the stopper 8 and to the ring 7 by thin, easily torn webs of plastics material, for example, is still in place between the stopper 8 and the ring 7. FIG. 2 shows the cap 6 after the strip 9 has been torn off, with the stopper 8 in the position closing off the neck 1 of the bottle.

Figure 3:
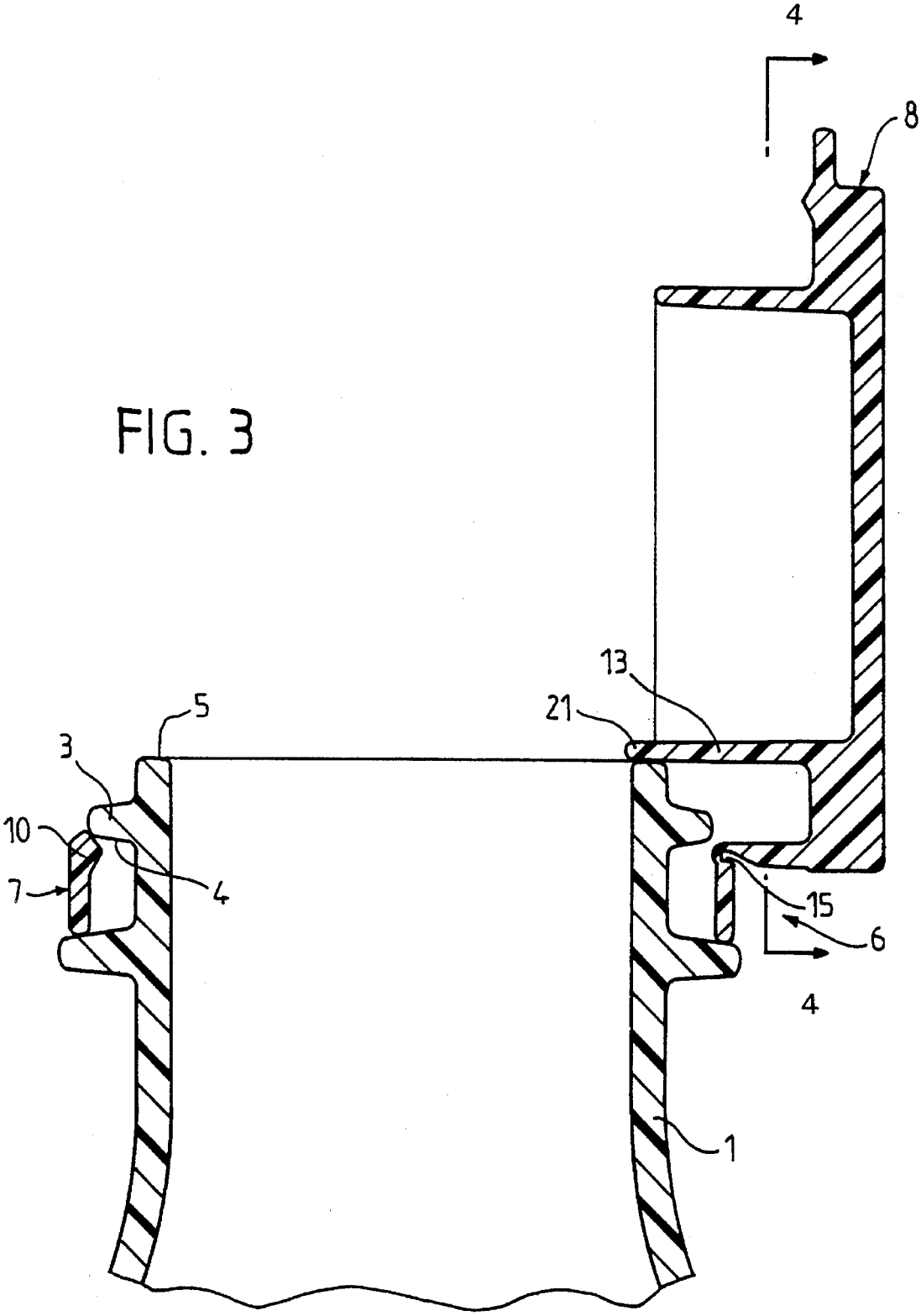
FIG. 3 is a section similar to that of FIG. 2 but with the stopper open.

FIG. 3 shows the stopper 8 in a position opened through 90°. The stopper 8 is held in this open position by bearing engagement of its skirt 13 on the upper edge 5 of the neck 1.

This facility for holding the stopper 8 in the open position entails conformance with various dimensional relationships explained below.

Firstly, the length 1 by which the skirt 13 of the stopper projects from the annular bearing surface 12 must be greater than the distance $h_1$ between the lower side 4 of the attachment flange 3 and the upper edge 5 of the neck 1.

Secondly, the distance $h_2$ by which the axis of the hinge 15 of the stopper 8 is offset relative to the annular bearing surface 12 must be equal to or greater than the distance $h_1$.

Finally, $h_1$ must be equal to or greater than $(d_2-d_1)/2$.

The values of the diameters $d_1$ and $d_2$ are determined by the bottle to be capped and the corresponding values on the cap must be chosen accordingly so that the cap is secured to the neck of the bottle and the bottle is sealed.

For a neck 1 having the usual shape and size (internal diameter $d_1$ of 21 mm), the value $(d_2-d_1)/2$ is usually equal to 4 mm.

The height $h_1$ is usually in the order of 3 mm, but can vary between approximately 2.5 mm and 3.8 mm.

In the case of necks for which the height $h_1$ is greater than 3 mm there is no difficulty in holding the stopper 8 in the open position.

However, on a cap for a neck for which the height $h_1$ is less than 3 mm (equal to 2.5 mm, for example), the ratio $(d_2-d_1)/2$ must be less than 2.5 mm. This is usually not possible, because of the minimal wall thicknesses employed.

Figure 4:
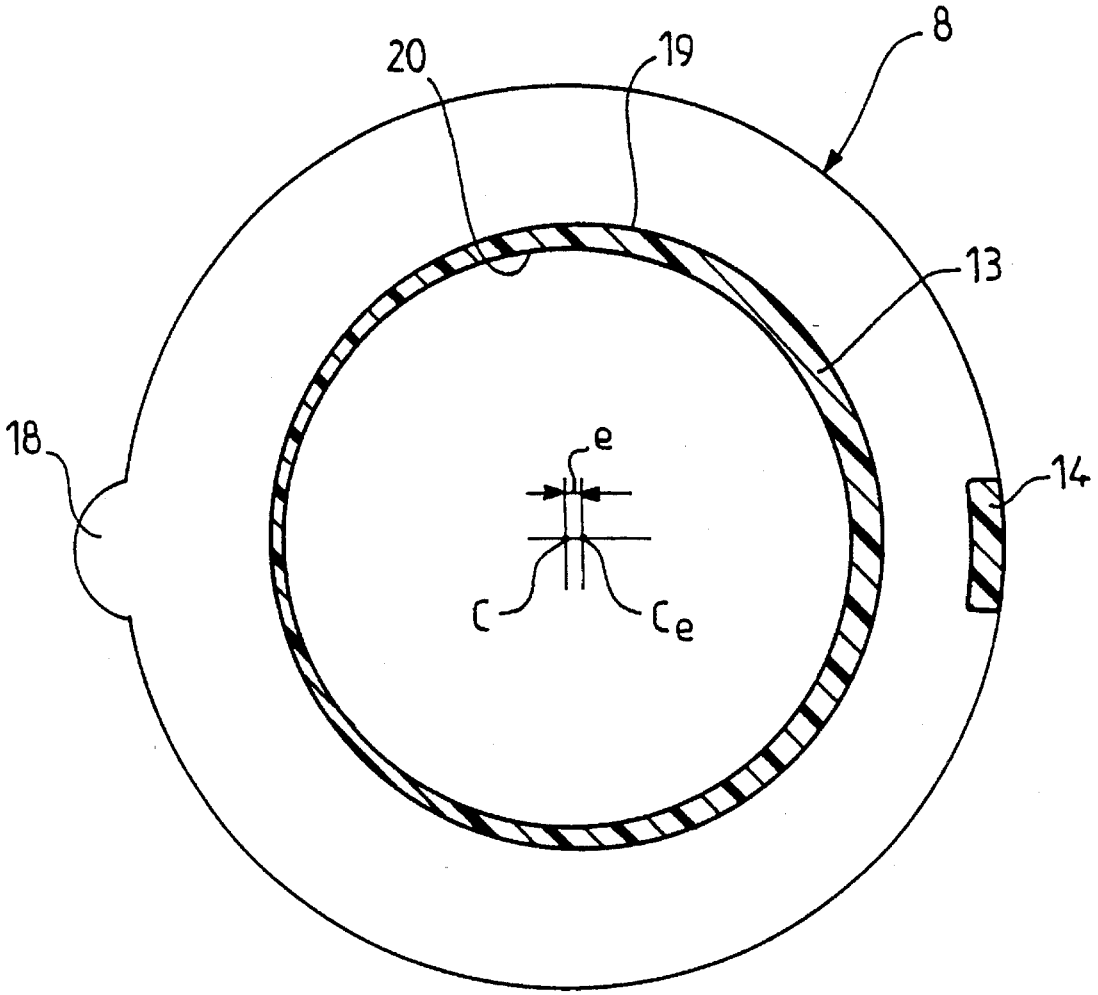
FIG. 4 is a section through a variant stopper on IV—IV in FIG. 3.

For this reason, as shown in FIG. 4, in this case the outside surface 19 of the sealing skirt 13 is offset towards the hinge 15 (lug 14) (centre $c_e$) relative to the centre c of the remainder of the stopper 8, by an amount e which in the above example would be equal to $\{[(d_2-d_1/2]-2.5\}/2$.

This solution retains an external cylindrical shape 19 of the skirt 13 to ensure a good seal combined with a stable open position of the stopper 8 at 90° or more.

The lower surface 20 of the sealing skirt 13 can be centred relative to the circular outside perimeter of the stopper, the thickness (in the radial direction) of the skirt being then greater on the side with the hinge 15 than on the opposite side.

As shown in FIG. 3 in particular, it is also possible to extend the sealing skirt 13 by means of a portion 21 on the side with the hinge 15 only, for improved cooperation of the skirt 13 with the upper edge 5 of the neck 1.

I claim:

1. A unitary, one-piece, container cap on a container, comprising:

a ring (7) with a bead (10) for attaching it by clipping behind an external flange (3) on a container neck, a stopper (8) with a perimeter having a disk (11), an annular bearing surface (12), and an annular sealing skirt (13) cooperating with the inside of the neck (1) which is joined by a hinge (15) to said ring (7), and a tamper proof strip (9) joining the stopper (8) to the ring (7) until it is torn off the first time the cap is opened, where capping said container having said neck (1) with said single attachment flange (3) at a distance from the upper edge (5) of the neck, the annular bearing surface (12) bears on the upper edge (5) of the neck and surrounds said entire skirt (13), said skirt (13) projecting from said bearing surface (12) over a length (1) greater than a distance ($h_1$) between a lower side (4) of the flange (3) and the upper edge (5) of the neck, and the hinge is offset relative to said annular bearing surface (12) towards the ring (7) by an amount ($h_2$) at least equal to said distance ($h_1$).

2. The cap according to claim 1 where an outside surface (19) of the sealing skirt (13) has an offset (e) towards the hinge (15) relative to the perimeter of the stopper (8).

3. The cap according to claim 2 where an inside surface (20) of the sealing skirt (13) is centered on the perimeter of the stopper, the skirt (13) having on the side with the hinge (15) a radial thickness greater than on the opposite side.

4. A closure and a container, comprising:

a neck with an upper edge and a single external attachment flange having a lower side located at a distance below said upper edge of the neck, and said closure being a one piece molded assembly, comprising:

an attachment ring portion having on its inside a bead for attaching it by snapping below said single external flange of the container neck;

a cap portion having a perimeter for closing the neck, said cap portion being joined by a hinge to said ring portion at the perimeter, and including an upper disc member defining a lower annular bearing surface for bearing on the upper edge of the container neck and for surrounding an annular sealing skirt projecting downwardly from said bearing surface of said disc member for fitting into the neck; and a tamperproof strip detachably joining said cap portion to said ring portion all around the perimeter of the cap portion except at said hinge;

where said entire skirt projects from said bearing surface over a length greater than a distance between the lower side of the flange and the upper edge of the neck, and said hinge is off-set relative to said annular bearing surface toward said ring portion by an amount at least equal to said distance.

5. The closure according to claim 4, wherein the sealing skirt has an outside surface exhibiting a cross-sectional circular shape and the cap portion has a circular perimeter and wherein the outside surface of the skirt is offset towards the hinge relative to the perimeter of the cap portion.

6. The closure according to claim 5, wherein the sealing skirt has an inside surface exhibiting a cross-sectional circular shape, and said inside surface of the sealing skirt is centered on the circular perimeter of the cap portion, said skirt having on the side nearest the hinge a radial thickness greater than on the opposite side.

7. A closure and a container, said container including a neck with an upper edge and a single external flange having a lower side located at a distance below the upper edge, said closure comprising:

a ring portion having an inside bead for attaching it by snapping below said single external flange of the container neck;

a cap portion for closing the container neck, said cap portion having a perimeter and joined by a hinge to said ring portion at one point of said perimeter, said cap portion comprising an upper disc member defining a lower annular bearing surface for bearing on the upper edge of the container neck and surrounding an annular sealing skirt having a substantially uniform length projecting downwardly from said bearing surface of said disc member for fitting into the container neck; and a tamperproof strip detachably joining said cap portion to said ring portion all around the perimeter of the cap portion except at said hinge;

where said skirt projects from said bearing surface over a length at least equal to said distance between the lower side of the flange and the upper edge of the container neck, said hinge is offset relative to said annular bearing surface towards said ring portion by an amount at least equal to said distance, said sealing skirt has an outside surface exhibiting a cross-sectional circular shape and the cap portion has a circular perimeter, and the outside surface of the skirt is offset toward the hinge relative to the perimeter of the cap portion and said closure is a one piece molded assembly.

8. The closure according to claim 7, wherein said length of the sealing skirt is greater than said distance.

9. The closure according to claim 8, wherein the sealing skirt has an outside surface exhibiting a cross-sectional circular shape and the cap portion has a circular outside perimeter and wherein the outside surface of the skirt is offset towards the hinge relative to the perimeter of the cap portion.

* * * * *